United States Patent [19]

Reschly

[11] Patent Number: 4,576,101

[45] Date of Patent: Mar. 18, 1986

[54] STOKER

[75] Inventor: David C. Reschly, Monroe, Mich.

[73] Assignee: Detroit Stoker Company, Monroe, Mich.

[21] Appl. No.: 583,981

[22] Filed: Feb. 27, 1984

[51] Int. Cl.[4] ..... F23L 5/00

[52] U.S. Cl. ..... 110/182.5; 110/101 R; 126/182; 126/152 R

[58] Field of Search ..... 126/77, 112, 182, 163 R, 126/152 R; 110/182.5, 101 R, 115, 314, 247, 275

[56] References Cited

U.S. PATENT DOCUMENTS

| | | | |
|---|---|---|---|
| 575,305 | 1/1897 | Morgan | 126/182 |
| 1,724,352 | 8/1929 | Iluing | 126/182 X |
| 1,761,182 | 6/1930 | Crothers | 110/182.5 X |
| 1,913,668 | 6/1933 | Haug | 110/275 X |
| 2,112,908 | 4/1938 | Hamilton | 110/182.5 X |
| 2,122,951 | 7/1938 | Riddell | 110/182.5 |
| 2,128,355 | 8/1938 | Felger et al. | 110/182.5 X |
| 2,140,520 | 12/1938 | Foresman | 110/275 X |

*Primary Examiner*—Larry Jones

*Attorney, Agent, or Firm*—Harness, Dickey & Pierce

[57] ABSTRACT

A stoker construction which readily adapts to a wide variety of different sized combustion chambers, utilizing a minimum number of standarized modules. The modules may be arranged singly, or in stacked combination, around the inner perimeter of the combustion chamber wall and cooperate with the fuel supporting grate to form a baffle or movable seal. The modules provide a downwardly converging surface for containing the fuel and define an air plenum and tuyere assembly for controlled admission of overfire air to promote a robust fire and to prevent clinker and slag formation.

34 Claims, 6 Drawing Figures

STOKER

BACKGROUND AND SUMMARY OF THE INVENTION

This invention relates generally to mechanical stokers, and more particularly to a stoker construction which uses inwardly converging tuyere modules disposed about the inner combustion chamber wall to permit easy expansion of a stoker design to accommodate a wide range of different sized combustion chambers with a minimum number of standarized parts. The improved construction may be used in both rotary grate and fixed grate stokers of a wide variety of designs.

Stokers of the prior art have been traditionally designed to custom fit within the wall structure which defines the combustion chamber of a furnace, boiler, or the like. Generally such stokers include a grate for supporting burning fuel, a means for feeding fuel onto the grate and a means for removing ash. Many modern day stokers employ rotating outer grates with stationary central sections which promote better fuel distribution, more even burning, and improved ash removal.

It is also known that combustion can be made more efficient and can be better controlled through the admission of pressurized air, in controlled proportions, to different combustion zones within the combustion chamber. For example, it is now common practice to use air plenums or wind boxes located beneath the fuel supporting grate to force air through the grate upwardly into the burning fuel pile. If desired, separate air plenums may feed separate zones above the grate. For example, in a rotary stoker having a stationary central grate section and an outer rotating ring section, a first air plenum might be used to admit air through tuyeres or air passages in the central stationary section, while a second air plenum might be used to admit air through the outer rotating ring. By separately controlling the air admitted from these two air plenums, combustion can be optimized in accordance with boiler or furnace demands. In addition, the controlled admission of air aids in reducing slag deposits and clinker formation, and also keeps the fuel supporting grate cooler to minimize burn through and promote longer life.

In many applications, it is also beneficial to provide for the controlled admission of air from above the fuel supporting grate as well as from beneath it. The controlled admission of overfire air provides many of the same benefits as air admitted beneath the fire, and also promotes a robust fire through controlled turbulence of the combustible exhaust gases and particulates for a more complete combustion. Prior art stokers which implement the admission of overfire air employ tuyeres which are formed within or formed flush with the inner combustion chamber walls, for directing pressurized air into the combustion chamber from air plenum sources located either within the furnace wall or around the exterior thereof.

A problem with all known prior art stokers is that the fuel supporting grate structures and air admission equipment must, to a great extent, be custom fit to each furnace, boiler or combustion system, since these combustion systems are not usually of standardized sizes. Accordingly, such custom-fit stokers tend to be expensive, considerably more so than if manufactured in standardized sizes. However, inasmuch as there is little, if any, industry wide standardization in the design and construction of boilers, furnaces and other combustion devices, there continues to be a need for a stoker design which will readily and economically accommodate a wide range of different sized combustion chambers with a minimum number of standardized parts.

The present invention provides an economical solution to the aforementioned stoker construction problems by providing a stoker for use within a wall structure which defines a combustion chamber of a given sized inner perimeter. The stoker comprises a fuel supporting grate sized to fit within the inner perimeter of the combustion chamber leaving a predetermined gap between chamber wall and grate. The stoker is also provided with a readily interchangeable outer periphery structure which, when properly selected and attached to the combustion chamber wall, adapts the stoker to conform to the inner perimeter of the chamber. A tuyere defining module is secured about the inner perimeter of the combustion chamber to span the predetermined gap between chamber wall and grate. The tuyere defining module has an outer periphery which conforms to the inner perimeter of the combustion chamber and has an inner periphery which cooperates with the outer peripheral flange structure of the fuel supporting grate to form a baffle.

The tuyere defining module comprises at least one submodule, which can be of a standardized size, and provides a downwardly converging surface for containing fuel. The tuyere defining module has a means receptive of pressurized air, such as a plurality of air passages communicating with an air plenum, for directing pressurized air into the combustion chamber above the grate. The tuyere defining module may, if required, be assembled from a plurality of standardized submodules stacked on top of one another, in stadium fashion, so that the stacked submodules each define part of the downwardly converging surface.

The invention further provides a compartment receptive of pressurized air defined by the outer periphery structure and located directly adjacent the tuyeres for supplying air through the tuyeres into the combustion chamber.

The invention thus provides a means, in the form of stackable tuyere modules defining an outer periphery structure, for adapting a standardized sized stoker to any given sized combustion chamber. By stacking a selected number of tuyere modules, in assembly with one another, the effective size of the fuel containment grate can be adjusted in relatively small, discrete increments to fit the combustion chamber. Finer size adjustment is made possible by providing a selection of different sized standardized tuyere modules.

For a more complete understanding of the invention, its objects and advantages, reference may be had to the following specification and to the accompanying drawings.

DESCRIPTION OF THE PREFERRED EMBODIMENT

Figure 1:
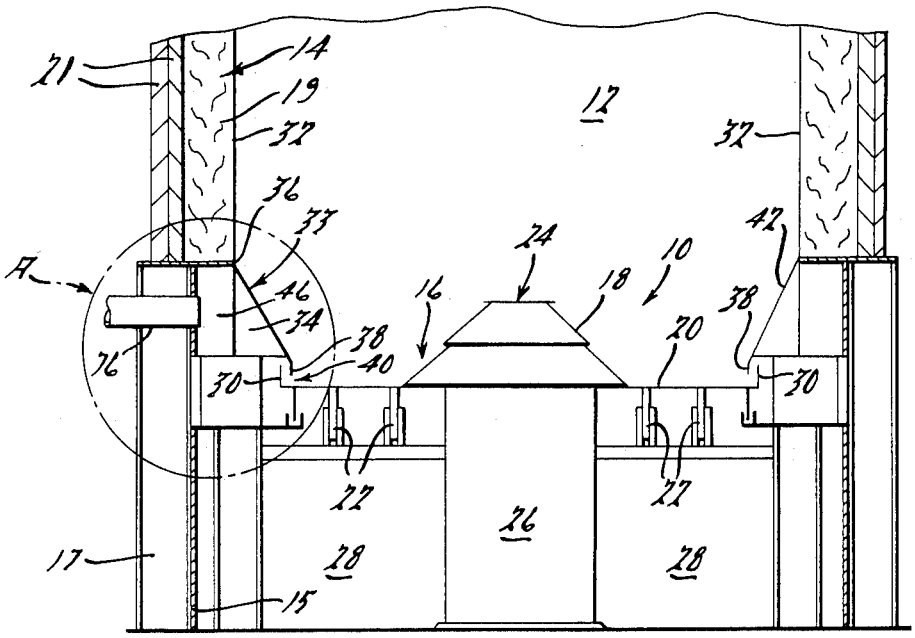
FIG. 1 is a diagrammatic vertical sectional view of a combustion chamber incorporating a stoker of the present invention employing a single tuyere defining module.
Figure 2:
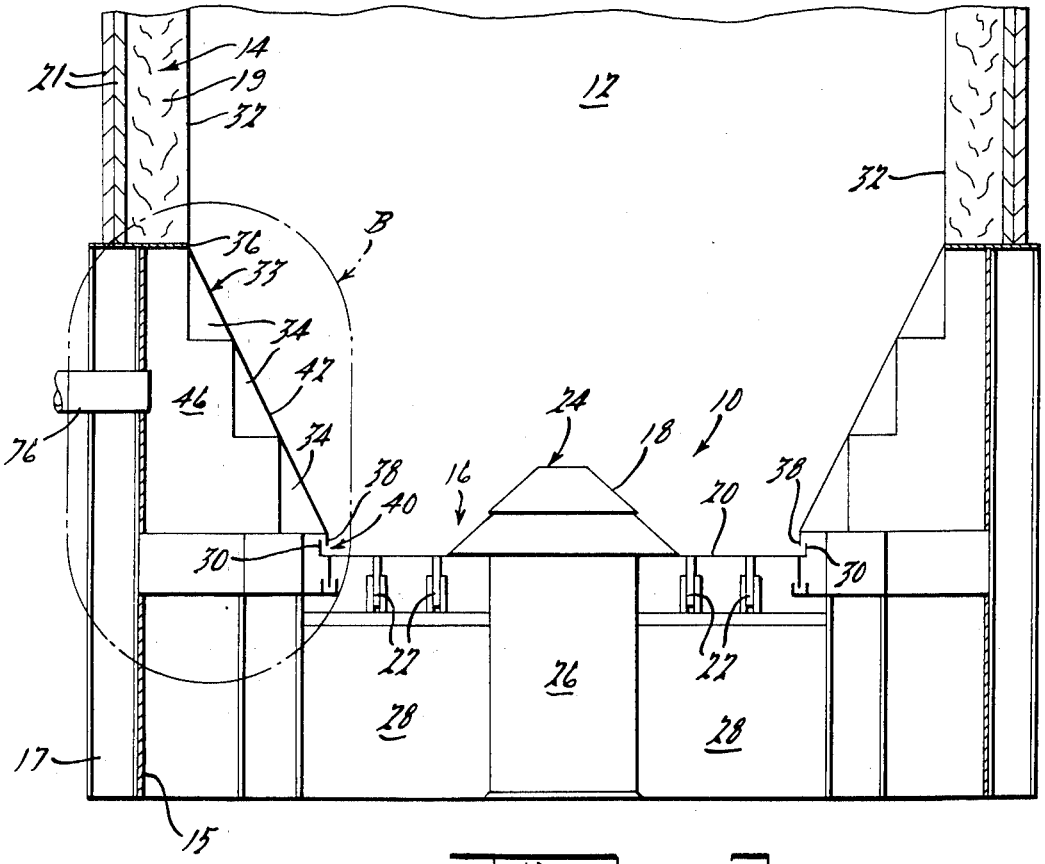
FIG. 2 is a similar diagrammatic cross-sectional view of the invention showing a tuyere defining module comprising three stacked submodules to accommodate a larger combustion chamber.

Referring to FIGS. 1 and 2, the stoker construction of the present invention is illustrated in conjunction with a rotary stoker 10. While a rotary stoker has been chosen to illustrate the invention, it will be understood that the invention is equally applicable to other types of stokers, including fixed grate stokers. Stoker 10 is disposed within combustion chamber 12 defined by wall structure 14 and includes generally continuous housing plate 15. Housing plate 15 has preferably a horizontally disposed cylindrical configuration for conforming to combustion chambers of circular cross-section. I-beam stiffeners 17 are spaced about housing plate 15 for added support and rigidiity. Wall structure 14 conventionally comprises refractory material layer 19 and several insulating layers 21. For purposes of illustrating the invention, it will be assumed that stoker 10 is a rotary stoker having a fuel supporting grate 16 comprised of a central conically shaped stationary grate section 18 and outer rotating ring section 20. Ring section 20 is supported as on rollers 22 for rotation about stationary grate section 18. Fuel is fed to feed point 24 in the center of grate section 18 by conventional overfeed or underfeed mechanisms. Combustion air is supplied through fuel supporting grate 16 by means of air plenum 26, which admits air through stationary grate section 18, and air plenum 28, which admits air through rotating ring section 20. For a more detailed understanding of rotary stokers, reference may be had to the U.S. application of David C. Reschly, Ser. No. 482,015, entitled "Rotary Continuous Ash Discharge of Stoker". Said application was filed Apr. 11, 1983, and is a continuation of application Ser. No. 62,327, filed July 31, 1979, now abandoned.

In accordance with the present invention, fuel supporting grate 16 is disposed within combustion chamber 12 and has an outer periphery 30 which is disposed in radially spaced relation to the inner perimeter 32 of combustion chamber 12. The invention includes outer periphery structure 33 comprising one or more tuyere defining modules 34, disposed around inner perimeter 32 of wall structure 14 generally above the grate 16. Outer periphery structure 33 has an outer perimeter 36 which conforms to or is congruent with inner perimeter 32 of wall structure 14 and has an inner perimeter 38 which cooperates with the outer periphery 30 of grate 16 to form baffle 40. Structure 33, and the module or modules 34 which comprise it, form downwardly converging generally continuous surface 42 defined between outer perimeter 36 and inner perimeter 38. For combustion chambers of a circular cross-section, this downwardly converging surface 42 is annular. Downwardly converging surface 42 is also provided with a plurality of tuyere defining holes 44, shown in FIGS. 3 through 6, which receive pressurized air from air compartment or air plenum 46 defined by outer periphery structure 33 and located directly adjacent module or modules 34. The tuyere defining holes 44 thus direct pressurized air into combustion chamber 12 generally above grate 16, and also generally above the burning fuel supported thereon.

Figure 3:
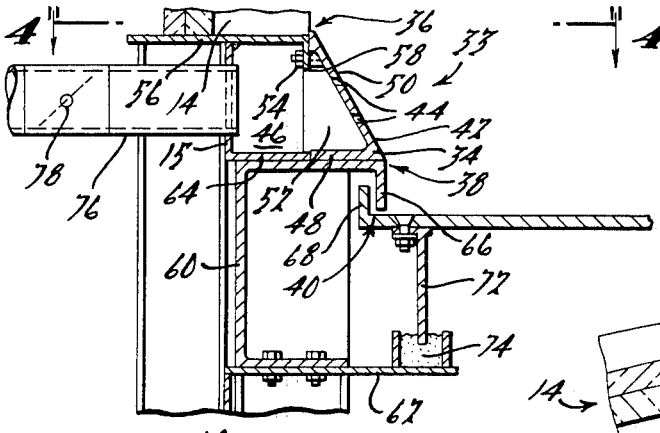
FIG. 3 is an enlarged fragmentary cross-sectional view of a portion of the stoker shown generally at A in FIG. 1.
Figure 5:
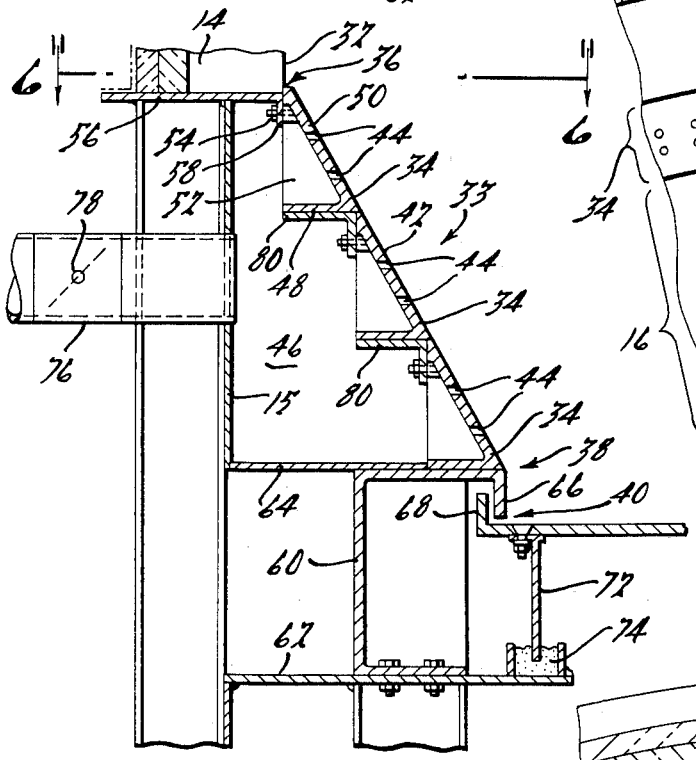
FIG. 5 is an enlarged fragmentary cross-sectional view of a portion of the stoker shown generally at B in FIG. 2.
Figure 4:
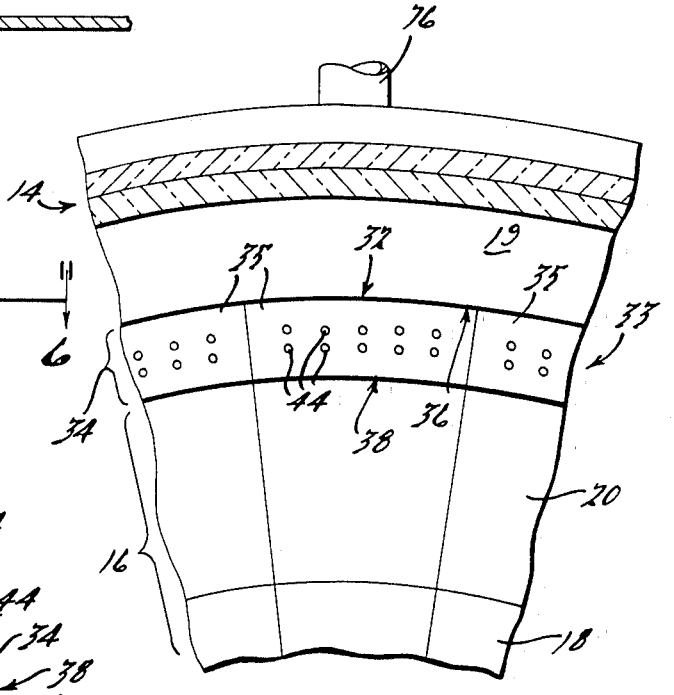
FIG. 4 is an enlarged fragmentary plan view taken substantially along the line 4—4 in FIG. 3.
Figure 6:
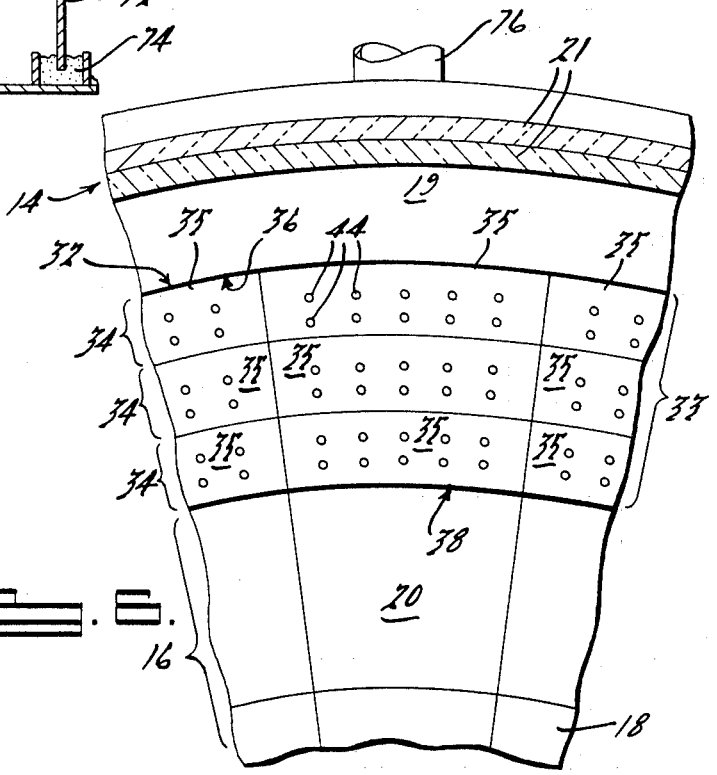
FIG. 6 is an enlarged fragmentary plan view taken substantially along the line 6—6 in FIG. 5.

Referring now to FIGS. 3 through 6, the invention will be illustrated in greater detail. Generally, FIGS. 3 and 4 illustrate an outer periphery structure 33 comprising a single tuyere defining module 34. Module 34 is generally annular and may be assembled from a plurality of standardized members or submodules 35 in accordance with the invention. FIGS. 5 and 6 illustrate an outer periphery structure 33 comprising a plurality of stacked tuyere defining modules 34 (three in this example), each being assembled from a plurality of standardized submodules 35. As seen in FIGS. 4 and 6, submodules 35 are generally arcuate segments which are arranged side by side to comprise module 34. It will be understood, of course, that any number of stacked tuyere defining modules may be used in practicing the invention. For purposes of illustrating the invention, it has been assumed that wall structure 14 defines a combustion chamber 12 of generally circular cross-section. Hence, fuel supporting grate 16 and tuyere defining modules 34 are shown having generally circular or annular configurations to conform to the circular combustion chamber. It will be undersrood, however, that wall structure 14 might define combustion chambers having non-circular cross-sections; hence the illustration of a circular fuel supporting grate 16 and annular tuyere defining modules 34 is to be considered as an example of the presently preferred embodiment, and not as a limitation of the scope of the invention as set forth in the appended claims.

Regardless of the number of tuyere defining modules 34 used, each module 34 is constructed or assembled from a plurality of submodules 35. Submodules 35 are cast, or otherwise fashioned, with base portion 48 and face portion 50, shown in FIGS. 3 and 5. In assembly, base portion 48 is generally horizontally disposed, while face portion 50 is angulated to define downwardly converging surface 42. Face portion 50 is provided with a plurality of tuyere defining holes 44. Base portion 48 and face portion 50 are integrally formed in acute angular relationship and are further joined by triangular web 52 for additional rigidity. As shown in FIGS. 4 and 6, submodules 35 are configured to define segments of the generally annular tuyere defining modules 34. The tuyere defining modules 34 may be used either singly or in stacked assembly to comprise the outer periphery structure 33. Preferably, the outer periphery structure 33 is secured, as with bolts 54, to horizontal plate 56, which separates wall structure 14 from housing plate 15. In this regard, horizontal plate 56 may be provided with a downturned flange 58 for receiving bolt 54. In this fashion, the uppermost and outermost perimeter 36 of outer periphery structure 33 is made to conform to inner perimeter 32 of wall structure 14. The lower most and innermost perimeter 38 of structure 33 is confined by C-shaped bracket structure 60. Bracket structure 60 is secured, as by bolting, to horizontal plate 62, which is, in turn, cantilevered from housing plate 15.

As shown in FIGS. 3 and 5, bracket structure 60 supports outer periphery structure 33 by retaining base portion 48 of the tuyere defining module located directly above. C-shaped bracket structure 60 also supports horizontal baffle 64 which defines air plenum 46 in conjunction with housing plate 15, horizontal plate 56, and the face portions 50 of modules 34. Bracket structure 60 is further provided with downturned flange 66 which overlaps upturned flange 68 at the outer periphery 30 of grate 16. The overlapping flanges 66 and 68 define annular baffle 40, which permits grate 16 to move or rotate with respect to outer periphery structure 33, and forms a seal preventing fuel and ash from sifting past the outer periphery of grate 16. To provide a further seal, grate 16 includes flange 72, which downwardly depends into sand filled or ash filled annular trough 74. Air duct 76 provides pressurized air to air plenum 46. Air duct 76 includes air flow regulator 78 so that the flow of pressurized air into air plenum 46, may be independently controlled for delivery to combustion chamber 12 through holes 44.

Comparing FIGS. 3 and 4 with FIGS. 5 and 6, it will be seen that the invention provides a stoker construction which may be readily adapted to combustion chambers of different sizes, simply by selecting and assembling one or more stacked tuyere defining modules 34. At the same time, the tuyere defining module or modules 34 assist in containing the fuel, by directing it along downwardly converging surface 42 away from wall structure 14. In addition, the tuyere defining module or modules 34 offer a convenient means of providing overfire air, i.e., air admitted from above the grate as opposed to from beneath the grate. This admission of air promotes a robust fire by controlling turbulence of the combustible exhaust gases and particulates for a more complete combustion. The air also cools the grate and aids in reducing slag deposits and clinker formation. As shown in FIG. 5, a plurality of tuyere defining modules 34 may be stacked, in stadium fashion, upon each other, while being held in place with angle brackets 80 bolted to face portion 50 for supporting the base portion 48 of the immediately adjacent module 34.

While a presently preferred embodiment of this invention has been illustrated and described in detail, it will be understood that modifications as to details of construction and design are possible without departing from the spirit of the invention or the scope of the following claims.

I claim:

1. A stoker for use within a wall structure defining a combustion chamber, comprising:

a grate for supporting burning fuel and having an outer periphery disposed in spaced relation to said wall structure; and tuyere defining means disposed around and secured to said wall structure generally above said grate;

said tuyere defining means comprising a plurality of distinct tiered modules, each having a substantially smooth and downwardly converging face with apertures therein, the combined faces together forming a downwardly converging surface for containing and inwardly directing said fuel and having means receptive of pressurized air communicating with said apertures for directing said air into said combustion chamber; and said tuyere defining means and said grate overlapping to define a baffle about the outer periphery of said grate for confining said fuel within the outer periphery of said grate.

2. The stoker of claim 1 wherein said grate is rotatable.

3. The stoker of claim 1 wherein said tuyere defining means overlaps said outer periphery of said grate.

4. The stoker of claim 1 wherein said air directing means includes an orifice in said downwardly converging surface.

5. The stoker of claim 1 wherein said tuyere defining means comprises first and second modules in stacked assembly with one another, each defining part of said downwardly converging surface.

6. The stoker of claim 1 wherein said downwardly converging surface is annular.

7. The stoker construction of claim 6 wherein said means for forming an air seal is disposed about said outer periphery of said grate.

8. The stoker of claim 1 further comprising compartment receptive of pressurized air located directly adjacent said tuyere defining means and communicating with said air directing means.

9. The stoker of claim 1 wherein said baffle forms a first seal, said grate defines a space therebeneath and said grate further comprises means for forming a second seal between said combustion chamber and said space.

10. A stoker construction for adapting a stoker to the inner periphery of a combustion chamber comprising:

a grate for supporting burning fuel disposed within said combustion chamber having an outer periphery set in radially spaced relation to said inner periphery of said combustion chamber; and tuyere defining means comprising a plurality of modules and having tuyere means for receiving and directing pressurized air into said combustion chamber;

said modules each having a face portion exposed to said combustion chamber and being stacked upon one another such that said face portions define a generally downwardly converging surface extending substantially from the inner periphery of the combustion chamber to the outer periphery of said grate and wherein said grate defines a space therebeneath and said stoker further comprises a means disposed about the outer periphery of said grate for defining an air seal between said combustion chamber and said space beneath said grate.

11. The stoker construction of claim 10 wherein said grate is rotatable.

12. The stoker construction of claim 10 wherein said tuyere defining module is stationary with respect to said combustion chamber.

13. The stoker construction of claim 10 wherein said tuyere defining module is secured on said inner periphery of said combustion chamber.

14. The stoker construction of claim 10 further comprising compartment receptive of pressurized air located directly adjacent said tuyere defining module for supplying air to said tuyere module.

15. The stoker construction of claim 10 wherein said outer periphery of said grate and said tuyere defining module cooperate to define a baffle means for permitting movement of said grate relative to said module for containing said fuel.

16. The stoker construction of claim 10 wherein said grate defines a space therebeneath and said stoker further comprises means for forming a seal between said combustion chamber and said space.

17. A tuyere defining module for use in a combustion chamber having an axis, comprising:

a first member having a base portion and a face portion coupled to said base portion in acute angular relationship therewith, said first member defining an interior space at least partially enclosed between said base portion and said face portion and separated from said combustion chamber by said face portion; and means for supporting said first member within said combustion chamber;

said face portion defining a substantially smooth and continuous surface which is downwardly converging toward said axis and has at least one tuyere defining hole communicating between said interior space and said combustion chamber.

18. The module of claim 17 wherein said first member further includes a web portion joined between said base portion and said face portion.

19. The module of claim 17 further comprising means for delivering pressurized air to said interior space.

20. The module of claim 17 wherein said first member defines a generally arcuate segment.

21. The module of claim 17 further comprising a second member substantially similar to said first member and disposed in side by side relationship thereto.

22. The module of claim 17 further comprising a plurality of additional members, each substantially similar to said first member, and disposed in side by side relationship to one another to define a generally closed structure.

23. The module of claim 22 wherein said closed structure is annular.

24. The module of claim 17 further comprising a second member generally similar to said first member and means for stacking said second member upon said first member.

25. The module of claim 24 wherein said second member includes a face portion which together with said face portion of said first member defines a generally continuous surface.

26. A stoker construction for adapting a stoker to the inner periphery of a combustion chamber comprising:

a grate for supporting burning fuel disposed within said combustion chamber having an outer periphery set in radially spaced relation to said inner periphery of said combustion chamber;

tuyere defining means having an upper periphery and a lower periphery, said lower periphery being smaller in size than said upper periphery; and means for introducing pressurized air through said tuyere means and into said combustion chamber generally above said grate;

said upper periphery being sized to conform to said inner periphery of said combustion and said lower periphery being sized to partially overlap said grate; and said outer periphery of said grate and said lower periphery of said tuyere defining means each having annular and generally vertically extending flanges in spaced relation to one another to define a seal.

27. The stoker construction of claim 26 wherein said tuyere defining means comprises at least two vertically stacked modules; and wherein the number of said modules is determined by radial spacing between said combustion chamber and said grate.

28. The stoker construction of claim 27 wherein said modules are generally annular.

29. The stoker construction of claim 27 further comprising:

a first module having a first upper periphery and a first lower periphery smaller than said first upper periphery; and a second module having a second upper periphery and a second lower periphery smaller than said second upper periphery;

said first lower periphery and said second upper periphery being substantially similar in size.

30. The stoker construction of claim 29 wherein said first lower periphery is slightly smaller in size than said second upper periphery.

31. The stoker construction of claim 29 wherein said first lower periphery is slightly larger in size than said second upper periphery.

32. The stoker construction of claim 29 wherein said first upper and lower peripheries and said second upper and lower peripheries are inner peripheries of said modules.

33. The stoker construction of claim 26 wherein said tuyere defining means has an upper inner periphery being larger in size than said lower periphery.

34. The stoker construction of claim 26 wherein said tuyere defining means has an upper inner periphery and a lower inner periphery, said upper inner periphery being larger in size than said lower inner periphery.

* * * * *

UNITED STATES PATENT AND TRADEMARK OFFICE

CERTIFICATE OF CORRECTION

PATENT NO. : 4,576,101

DATED : March 18, 1986

INVENTOR(S) : David C. Reschly

It is certified that error appears in the above-identified patent and that said Letters Patent is hereby corrected as shown below:

Column 8, line 5, Claim 26, after "combustion" insert -- chamber --.

Signed and Sealed this

*Twenty-ninth* Day of *July 1986*

[SEAL]

*Attest:*

DONALD J. QUIGG

*Attesting Officer*

*Commissioner of Patents and Trademarks*